United States Patent [19]

Rovner

[11] 4,056,997

[45] Nov. 8, 1977

[54] REED HOLDING DEVICE FOR MUSICAL INSTRUMENTS

[76] Inventor: Philip Lee Rovner, 6 Tentmill Lane-F, Baltimore, Md. 21208

[21] Appl. No.: 753,893

[22] Filed: Dec. 23, 1976

[51] Int. Cl.[2] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 555,561 | 3/1896 | Cadwallader | 84/383 |
| 2,483,327 | 9/1949 | Stalowski | 84/383 |
| 3,413,113 | 3/1969 | Portnoy | 84/383 |

*Primary Examiner*—Lawrence R. Franklin
*Attorney, Agent, or Firm*—Lane, Aitken, Dunner & Ziems

[57] ABSTRACT

A reed holding device for the mouthpiece of a musical instrument in which a single unitary strip extends around and in engagement with the outer surfaces of portions of the reed and the mouthpiece to secure the reed to the mouthpiece. The thickness of the strip varies from a minimum thickness along the area of engagement with the reed to a maximum thickness along an area of engagement with the mouthpiece to provide a graduated mechanical impedance to the reed during exitation.

19 Claims, 7 Drawing Figures

REED HOLDING DEVICE FOR MUSICAL INSTRUMENTS

BACKGROUND OF THE INVENTION

This invention relates to mechanical reed musical instruments such as clarinets, saxophones and the like and more particularly to a device for supporting a reed relative to the mouthpiece of the instrument.

In a typical mechanical reed musical instrument, energy in a steady air stream is converted to acoustical energy by virtue of the air stream being throttled by an air actuated vibrating reed, with the acoustical output usually being coupled to a resonant air column to produce musical sounds.

In the design of these type instruments it has long been recognized that the effects of vibrating reeds are important in tone production and moreover, the manner in which the reed is clamped relative to the mouthpiece significantly modifies the reed behavior.

One of the most important goals in the design of a reed for the above type musical instruments is to reduce the tendancy of the reed to vibrate in accordance with its own internal resonant modes, and thus allow the reed to function more faithfully in accordance with the air column resonances of the instrument. In this context, the construction and arrangement of the device for securing the reed relative to the mouthpiece of the instrument is extremely important since it is an integral part of the vibrating system. For example, these reed holding devices, commonly referred to as "ligatures", must permit the reed to vibrate freely while absorbing and dissipating unwanted resonances in the body of the reed, yet allow the reed to swell and shrink from moisture flow without undue constriction of the reed and resultant distortion of the reed body. In addition, the ligature should enable the player to easily adjust the degree of holding pressure upon the reed body with a minimum of effort.

Early type ligatures were in the form of a cord-like material which was wrapped around the reed and the mouthpiece to attach the former to the latter. It can be appreciated that this was extremely inconvenient and cumbersome to do and could only be done with the expenditure of a great deal of time. As a result, metal, and more recently, plastic, clamps or ligatures became popular since they could be designed to quickly remove the reed from the mouthpiece in the event that the latter had to be replaced or changed. However, it is well recognized that the metal ligature suffers from a lack of accurate tonal quality when compared to cord-like, or fabric, ligatures. This is largely due to the fact that metal ligatures tend to reflect a great portion of the vibrant energy from the reed back into the reed and thus provide a relatively low damping of mechanical resonances and a poor resistive termination for the standing waves that are generated in the reed during exitation as compared to the cord or fabric type ligatures. As a result, the metal ligature effects both pitch and amplitude of the notes played which, of course, is highly undesirable. Also, a cane reed, which is one of the most popular type of reeds now in use, undergoes significant growth and shrinkage during a performance as a result of the constantly changing moisture content within its body. With a metal ligature, its lack of compliance causes the reed to be constricted in its growth therefore causing it to distort to the point where its function is detrimentally effected. As a result the cane reed would become totally unacceptable for future play after this distortion did occur.

Although several other ligature designs, such as those utilizing fabric, plastic, or rubber, have been proposed to alleviate the deficiencies of the metal ligature discussed above, these designs present a very specific mechanical impedance to the energy from the reed and thus suffer from an inability to adequately damp and terminate all of the mechanical resonances and standing waves that are generated in the reed during exitation. As a result the reed is caused to vibrate more in accordance with its own internal resonant modes and thus functions less faithfully in accordance with the air column resonances of the instrument, resulting in less than optimum tonal quality, intonation, evenness of scale, and playing ease.

SUMMARY OF THE INVENTION

It is therefore an object of the present invention to provide a reed-holding device for a mouthpiece of a musical instrument which allows the reed to vibrate freely so as to produce a superior tonal quality.

It is a further object of the present invention to provide a reed-holding device of the above type which provides a graduated mechanical impedance and thus absorbs energy from the reed during exitation.

It is a more specific object of the present invention to provide a reed-holding device of the above type which effectively damps and terminates a relatively large number of mechanical resonances and standing waves generated by the reed during exitation.

It is a still further object of the present invention to provide a device of the above type which suppresses the tendancy of the reed to inject its own resonant modes into certain notes and thus effect the pitch and volume of the latter.

It is a still further object of the present invention to provide a device of the above type which can be removed, installed, and adjusted relatively quickly and easily.

Toward the fulfillment of these and other objects the device of the present invention comprises a reed-holding device for a mouthpiece of a musical instrument, the device comprising a single, unitary strip extending around and in engagement with the outer surfaces of portions of the reed and the mouthpiece to secure the reed to the mouthpiece. The thickness of the strip varies from a minimum thickness along the area of engagement with the reed, to a maximum thickness along an area of engagement with the mouthpiece to provide a graduated mechanical impedance to the energy from the reed during exitation. The strip can be formed by a fabric material, the end portions of which are folded back with a portion of each of the folded back end portions being secured to the corresponding inner surfaces of the strip to form two portions of double thickness with the folded back end portions extending in a spaced relation so that a single thickness portion is defined between the portions of double thickness for engaging the reed. Alternatively, the strip may be formed of a layer of material having a layer of rubber material molded to its inner or outer surface with the thickness of the layer of rubber material varying along its length to form the portion of minimum thickness and the portion of maximum thickness.

DESCRIPTION OF THE PREFERRED EMBODIMENT

Figure 1:
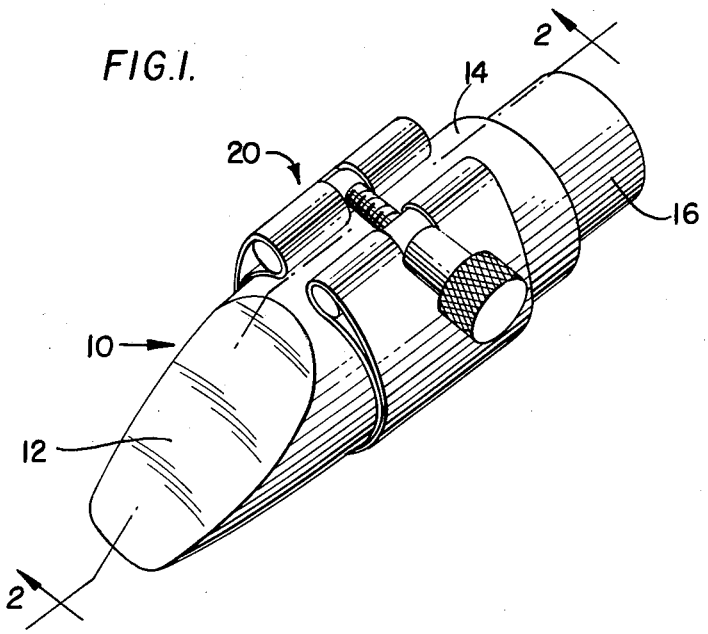
FIG. 1 is a perspective view depicting the reed-holding device of the present invention shown installed relative to a mouthpiece and holding a reed in proper operating position relative the mouthpiece.
Figure 2:
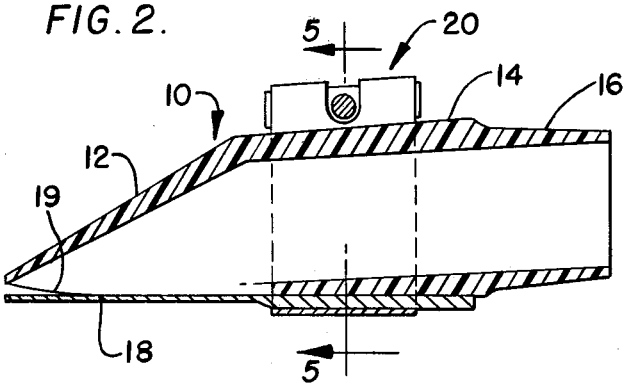
FIG. 2 is a cross-sectional view taken along the line 2—2 of FIG. 1.

Referring to FIGS. 1 and 2 of the drawings the reference numeral 10 refers in general to a mouthpiece of a mechanical reed musical instrument such as a clarinet, saxophone, or the like. The mouthpiece 10 is of a generally cylindrical shape and has a tapered front end portion 12, a slightly tapered main body portion 14 and a tapered, reduced rear end portion 16 which is adapted to fit to the instrument in a conventional manner.

A reed 18 extends over a flat surface formed on the lower surface of the main body portion 14 of the mouthpiece 10 as viewed in FIG. 2 and over a hollow opening, or slot, 19 formed in the front end portion 12. One embodiment of the device of the present invention is shown in general by the reference numeral 20 in FIGS. 1 and 2 and in general, is adapted to extend around the main body portion 14 of the mouthpiece 10 and the reed 18 to secure the reed to the mouthpiece in the position shown in FIG. 2.

Figure 3:
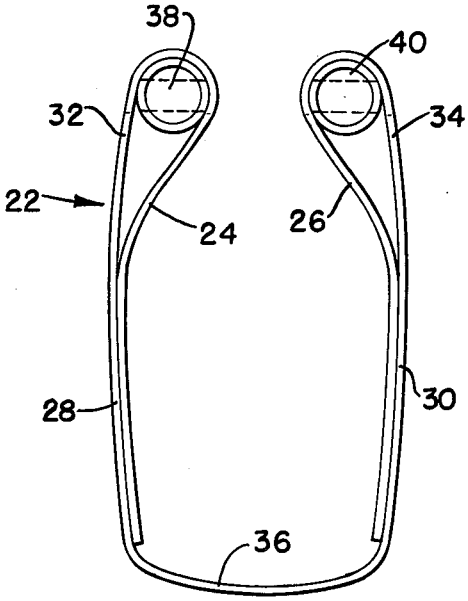
FIG. 3 is an enlarged elevational view depicting the device of the present invention.

The device 20 is shown in particular in FIG. 3 and includes a strip 22 of rubberized fabric material having two end portions 24 and 26 folded back over remaining portions of the strip. The leading end portions of the folded back portions 24 and 26 are secured to the corresponding inner surfaces of the strip along a predetermined length to form two portions 28 and 30 of a double thickness and two loops 32 and 34. The folded back portions 24 and 26 may be adhered to their corresponding inner surfaces of the strip 22 in any conventional manner such as by adhesive, sewing, fasteners, or the like. The ends of the strip 22 extend in a spaced relation so that a portion 36 of a single thickness is formed between the two double thickness portions 28 and 30. A pair of bars 38 and 40 of a hard material, such as steel, extend through the loops 32 and 34 and for the entire width of the strip 22.

Figure 4:
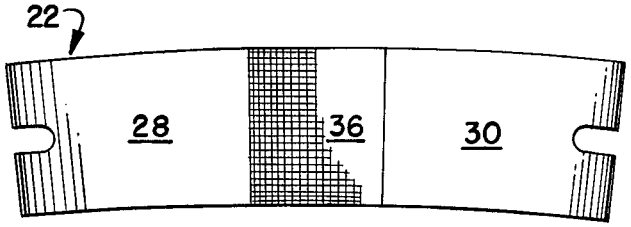
FIG. 4 is a plan view of the strip portion of the device of the present invention shown in an open condition.

As better shown in FIG. 4, the inner surface of the single layered portion 36 of the strip 22 is impregnated with rubber and is textured in a relatively fine waffle pattern. Although only the single layered portion 36 can be so impregnated, it is within the scope of the invention to impregnate and texture the entire inner surface of the strip in this manner. This impregnation and texturing may be done in a manner known in the art and therefore will not be described in any further detail. It is also noted in FIG. 4 that the longitudinal edges of the strip 22 are slightly arcuate in shape in order to correspond to the tapered main body portion 14 of the mouthpiece 10.

Figure 5:
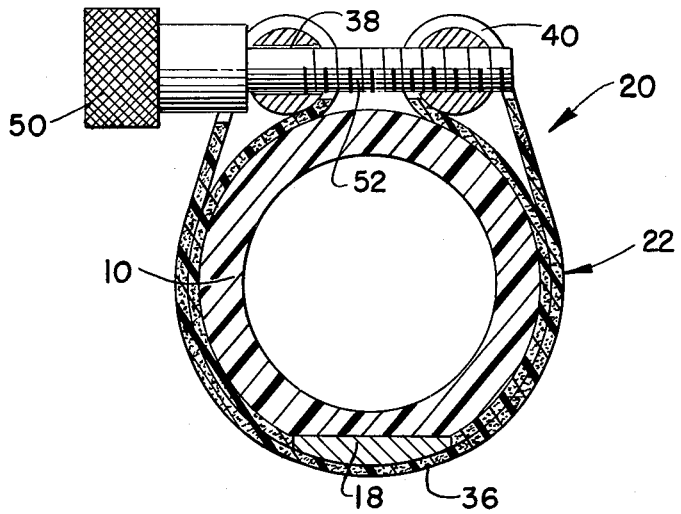
FIG. 5 is an enlarged cross-sectional view taken along the line 5—5 of FIG. 2.

Referring specifically to FIG. 5 the length of the single layered portion 36 of the strip 22 is sized so as to be approximately equal to the width of the reed 18 and engages the outer surface of the latter to snugly secure it relative to the mouthpiece 10. The remaining portions of the strip 22 extend around the outer surface of the main body portion 14 of the mouthpiece 10, with the ends of the loops 32 and 34 resting on the upper surface of the mouthpiece. A connecting bolt 50 is provided for securing the strip 22 around the mouthpiece 10 and has a threaded end portion 52 extending through an oversized opening formed through the bar 38 in a direction perpendicular to its longitudinal axis to permit free movement of the end portion 52 relative to the bar 38. The bar 40 has an internally threaded bore formed therethrough which also extends at a direction perpendicular to its longitudinal axis, which bore is threadedly engaged by the end portion 52 of the bolt 50. As a result the end portion 52 of the bolt 50 can be inserted through the bar 38 and in threaded engagement with the bar 40 and turned to advance the bars 38 and 40 relative to each other to snugly secure the strip 22 over the mouthpiece 10 and the reed 18, and thus securely fasten the reed to the mouthpiece.

It is noted by an inspection of FIGS. 3 and 5, that a graduated mechanical impedance to the energy from the reed is provided by virtue of the transition from the single layered portion 36 to the two double layered portions 28 and 30 of the strip and eventual termination at the stress holding bars 38 and 40. This, plus the use of the rubber impregnated fabric, not only permits free reed vibration but, in addition, enables a relatively large amount of high resonant peaks to be absorbed as a result of the high degree of damping of the mechanical resonances which is the result of a graduated resistive termination of the standing waves that are generated in the reed during exitation. Therefore, the instrument produces a superior tone quality, evenness of scale and playing ease.

It is also noted that the single adjustment bolt 50 permits the player to easily adjust the degree of holding pressure upon the reed and, in addition, permits the reed to be easily removed for replacement or cleaning.

Figure 6:
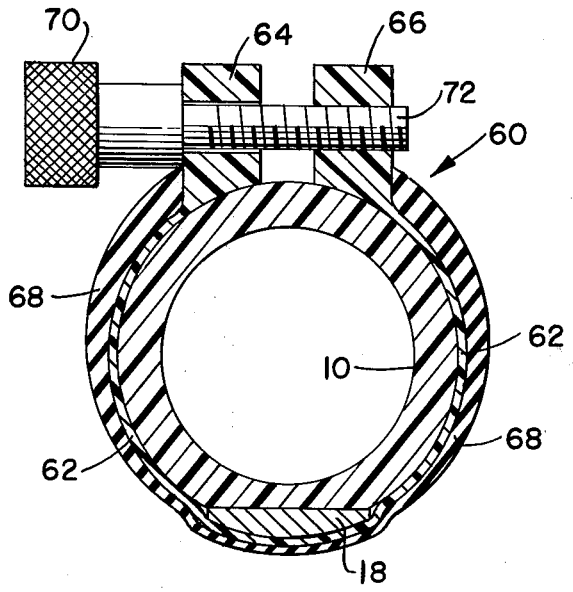
FIGS. 6 and 7 are views similar to FIG. 5 but depicting alternative embodiments of the device of the present invention.

Referring to FIG. 6 an alternate embodiment of the reed-holding device of the present invention shown in general by the reference numeral 60 and is adapted to secure the reed 18 to the mouthpiece 10 in a similar manner to that of the embodiment of FIGS. 1–5. In particular, the device 60 includes a band 62 of a plastic material extending over the outer surface of a portion of the reed 18 and the mouthpiece 10 in engagement therewith. The band 62 terminates in a pair of mounting flanges 64 and 66 which extend in a spaced relationship at a point approximately diametrically opposite that of the location of the reed 18. The flanges 64 and 66 may be formed integral with, or secured to, the band 60 in a conventional manner. A layer 68 of a rubber material is molded to the outersurface of the band 62 with the thickness of said rubber material varying along its length from a minimum along the area engagement with the reed 18 to a maximum at its end portions at the juncture, or point of connection, with the flanges 64 and 66. As a result, the layer 68 of rubber material presents a graduated mechanical impedance to the energy from the reed during exitation as discussed in connection with the previous embodiment. Although not clear from the drawing, it is understood that the width of the strip formed by the band 62 and the layer 68 of rubber material is the same as the width of the strip 22 of the previous embodiment.

A connecting bolt 70 is provided for securing the strip formed by the band 62 and the rubber layer 68 around the mouthpiece 10 and has a threaded end portion 72 extending through an oversized opening formed through the mounting flange 64 to permit free movement of the end portion relative to the flange. The flange 66 has an internally threaded bore formed therethrough which is threadedly engaged by the end portion 72. As a result the end portion 72 of the bolt can be inserted through the flange 64 and in threaded engagement with the flange 66 and turned to advance the flanges relative to each other to snugly secure the strip formed by the band 62 and the layer of rubber material 68 over the mouthpiece 10 and the reed 18 as in the previous embodiment, to securely fasten the reed to the mouthpiece.

Figure 7:
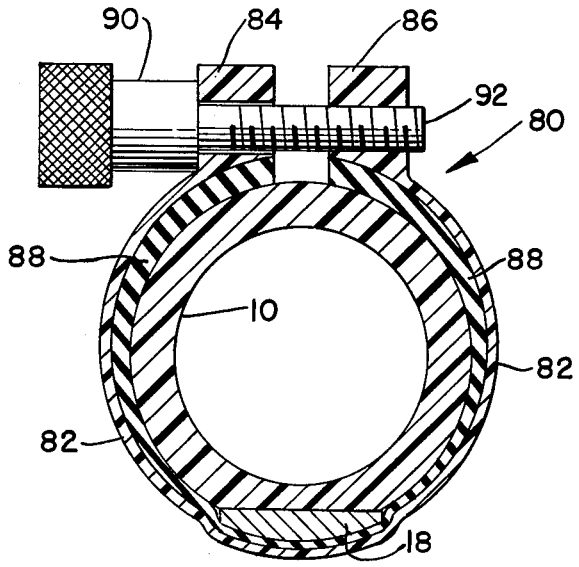

FIG. 7 depicts still another alternate embodiment of the reed-holding device of the present invention which is shown in general by the reference numeral 80 and which is adapted to secure the reed 18 to the mouthpiece 10 in a similar manner to that of the previous embodiments. In particular, the device 80 includes a band 82 of a plastic material extending over the outer surface of a portion of the reed 18 and the mouthpiece 10 and terminating in a pair of mounting flanges 84 and 86 which extend in a spaced relationship at a point approximately diametrically opposite that of the location of the reed 18. The flanges 84 and 86 may be formed integral with, or secured to, the band 80 in a conventional manner. A layer 88 of a rubber material is molded to the inner surface of the band 82 and engages the corresponding surfaces of the mouthpiece 10 and the reed 18. The thickness of the rubber layer 88 varies along its length from a minimum along the area engagement with the reed 18 to a maximum at its end portions at the juncture, or point of connection, with the flanges 84 and 86. As a result, the layer 88 of rubber material presents a graduated mechanical impedance to the energy from the reed during exitation as discussed in connection with the previous embodiments. Although not clear from the drawing it is understood that the width of the strip formed by the band 82 and the layer 88 of rubber material is the same as the width of the strips of the previous embodiments.

A connecting bolt 90 is provided for securing the strip formed by the band 82 and the rubber layer 88 around the mouthpiece 10 and has a threaded end portion 92 extending through an oversized opening formed through the mounting flange 84 to permit free movement of the end portion relative to the flange. The flange 86 has an internally threaded bore formed therethrough which is threadedly engaged by the end portion 92. As a result the end portion 92 of the bolt can be inserted through the flange 84 and in threaded engagement with the flange 86 and turned to advance the flanges relative to each other to snugly secure the strip formed by the band 82 and the layer of rubber material 88 over the mouthpiece 10 and the reed 18 as in the previous embodiments, to securely fasten the reed to the mouthpiece.

It is understood that the materials used in each of the disclosed embodiments can be varied within the scope of the present invention. For example, the bands 62 and 82 of the embodiments of FIGS. 6 and 7, respectively, can be of plastic, metal or any other material compatible with the design requirements of the devices disclosed. Also, the layers 68 and 88 can be made of a material other than rubber, such as a rubberized fabric, or the like, also as long as the design requirements are satisfied.

Of course, still other variations of the specific construction and arrangement of the devices disclosed above can be made by those skilled in the art without departing from the invention as defined in the appended claims.

I claim:

1. A reed holding device for a mouthpiece of a musical instrument, said device comprising a single unitary strip extending around the outer surfaces of portions of said reed and said mouthpiece, fastening means for securely fastening said strip in engagement with said reed and said mouthpiece to secure said reed to said mouthpiece, the thickness of said strip varying from a minimum thickness along the area of engagement with said reed, to a maximum thickness along an area of engagement with said mouthpiece to provide a graduated mechanical impedance to the energy from said reed during exitation.

2. The device of claim 1 wherein the maximum thickness of said strip occurs along an area of engagement with said mouthpiece most remote from said area of engagement with said reed.

3. The device of claim 1 wherein the ends of said strip extend in a spaced relationship and wherein said fastening means cooperates with said ends.

4. The device of claim 3 wherein said fastening means comprises a connecting flange of a relatively hard material formed on said ends of said strip, and a connecting bolt cooperating with said flanges, said flanges providing an additional mechanical impedance to said energy from said reed of a greater value than the impedance of the portion of said strip of maximum thickness.

5. The device of claim 1 wherein loops are formed by the end portions of said strip and wherein said fastening means includes a bar extending through each of said loops and a connecting bolt cooperating with said bars, said bars providing an additional mechanical impedance to said energy from said reed of a greater value than the impedance of the portion of said strip of maximum thickness.

6. The device of claim 1 wherein the length of the portion of said strip of minimum thickness is substantially equal to the width of said reed.

7. The device of claim 1 wherein the end portions of said strip are folded back, a portion of each of said folded back end portions being secured to the corresponding inner surfaces of said strip to form two portions of double thickness, said folded back end portions extending in a spaced relation so that a single thickness portion is defined between said portions of double thickness for engaging said reed.

8. The device of claim 7 wherein said folded back end portions form two loops and further comprising a holding bar of a relatively hard material extending through each of said loops, and fastening means cooperating with said bars for securely fastening said strip around said mouthpiece and said reed relative to said mouthpiece.

9. The device of claim 8 wherein said bars extend perpendicular to the longitudinal axis of said strip.

10. The device of claim 7 wherein the inner surface of said single thickness portion is impregnated with rubber and is textured in a relatively fine waffle pattern.

11. The device of claim 7 wherein the inner surface of said strip is impregnated with rubber and is textured in a relatively fine waffle pattern.

12. The device of claim 7 wherein the length of said single thickness portion is substantially equal to the width of said reed.

13. The device of claim 1 wherein said strip is formed by a layer of material having a layer of rubber material molded to its inner surface, the thickness of said layer of rubber material varying to form said portion of minimum thickness and said portion of maximum thickness.

14. The device of claim 1 wherein said strip is formed by a layer of material having a layer of rubber material moded to its outer surface, the thickness of said layer of rubber material varying to form said portion of minimum thickness and said portion of maximum thickness.

15. A reed holding device for a mouthpiece of a musical instrument, said device comprising a strip of fabric material the end portions of which are folded back, a portion of each of said folded back end portions being secured to the corresponding inner surfaces of said strip to form two portions of double thickness and two loops, said folded back end portions extending in a spaced relation so that a single thickness portion is defined between said portions of double thickness for engaging said reed; a holding bar of a relatively hard material extending through each of said loops, and fastening means cooperating with said bars for securely fastening said strip around said mouthpiece and said reed relative to said mouthpiece.

16. The device of claim 15 wherein said bars extend perpendicular to the longitudinal axis of said strip.

17. The device of claim 15 wherein the inner surface of said single thickness portion is impregnated with rubber and is textured in a relatively fine waffle pattern.

18. The device of claim 15 wherein the inner surface of said strip is impregnated with rubber and is textured in a relatively fine waffle pattern.

19. The device of claim 15 wherein the length of said single thickness portion is substantially equal to the width of said reed.

* * * * *